US005733107A

United States Patent [19]

Ikeda et al.

[11] Patent Number: 5,733,107

[45] Date of Patent: Mar. 31, 1998

[54] LUBRICANT OIL SEPARATING MECHANISM FOR A COMPRESSOR

[75] Inventors: Hayato Ikeda; Tomoji Tarutani; Hirofumi Sato; Norikazu Deto, all of Kariya, Japan

[73] Assignee: Kabushiki Kaisha Toyoda Jidoshokki Seisakusho, Kariya, Japan

[21] Appl. No.: 696,474

[22] Filed: Aug. 14, 1996

[30] Foreign Application Priority Data

Aug. 21, 1995 [JP] Japan ..... 7-212198

[51] Int. Cl.[6] ..... F04B 39/00

[52] U.S. Cl. ..... 417/312; 417/769; 417/313; 418/DIG. 1; 92/154; 184/6.17

[58] Field of Search ..... 417/312, 313, 417/902, 269; 55/457, 464; 418/DIG. 1; 92/154; 184/6.17

[56] References Cited

U.S. PATENT DOCUMENTS

| | | | |
|---|---|---|---|
| 4,019,342 | 4/1977 | Ohta | 417/313 |
| 4,392,788 | 7/1983 | Nakamura et al. | 417/269 |
| 4,486,153 | 12/1984 | Romer et al. | 417/312 |
| 4,582,468 | 4/1986 | Bar | 417/902 |
| 4,929,157 | 5/1990 | Steele et al. | 417/312 |
| 5,129,792 | 7/1992 | Abousabba | 417/312 |
| 5,133,647 | 7/1992 | Herron et al. | 417/312 |
| 5,443,371 | 8/1995 | Calciolari | 417/312 |
| 5,499,515 | 3/1996 | Kawamura et al. | 418/DIG. 1 |
| 5,556,265 | 9/1996 | Michiyuki et al. | 417/312 |
| 5,580,224 | 12/1996 | Ikeda et al. | 417/269 |
| 5,636,974 | 6/1997 | Ikeda et al. | 92/154 |

FOREIGN PATENT DOCUMENTS

| | | |
|---|---|---|
| 2149889 | 8/1987 | Japan . |
| 2308986 | 12/1990 | Japan . |
| 6436581 | 12/1990 | Japan . |

*Primary Examiner*—Charles G. Freay
*Assistant Examiner*—Peter G. Korytnyk
*Attorney, Agent, or Firm*—Brooks Haidt Haffner & Delahunty

[57] ABSTRACT

A compressor with a compressing device compresses gas containing oil mist. The compressing device includes a compression chamber. A receiving chamber receives the compressed gas discharged from the compression chamber. The receiving chamber has a duct for discharging the gas from the receiving chamber. A hollow cylinder communicates with the duct and projects inside the receiving chamber. The gas directed toward the duct flows around the cylinder to generate centrifugal force for separating the oil mist from the gas.

24 Claims, 7 Drawing Sheets

LUBRICANT OIL SEPARATING MECHANISM FOR A COMPRESSOR

BACKGROUND OF THE INVENTION

1. Field of the Invention

The present invention relates generally to a swash plate type compressor. More particularly, the present invention pertains to a lubricant oil separating mechanism for separating lubricant oil from refrigerant gas discharged from the compressor to an external cooling circuit.

2. Description of the Related Art

Vehicle air-conditioners generally have a compressor for air conditioning. The compressor compresses refrigerant gas drawn in from an external cooling circuit and discharges compressed gas back to the external cooling circuit. Misted lubricant oil is suspended in the refrigerant gas. Misted oil, together with refrigerant gas, circulates in the compressor for lubrication of movable parts. When being discharged into a refrigerating circuit together with the refrigerant gas, oil adheres to the inner walls of an evaporator in the refrigerating circuit. This reduces the heat exchange efficiency of the compressor. It is therefore desirable to separate oil from the refrigerant gas when the compressor discharges the refrigerant gas to the external cooling circuit.

FIG. 11 shows a conventional swash plate-type compressor including a lubricant oil separating mechanism. This compressor has a discharge muffler 72 provided on a cylinder block 71. The discharge muffler 72 has a muffler chamber 72*a* formed therein. A discharge port 73 is formed in the top portion of the muffler 72 for connecting the muffler chamber 72*a* to an external cooling circuit (not shown). A plurality of plates 74 (only two of them are shown in FIG. 11) are formed to protrude alternately with a predetermined space in between from the top wall and the bottom wall of the muffler chamber 72*a*.

Rotation of a rotary shaft 75 reciprocates a piston 78 in a cylinder bore 77 of the cylinder block 71 with a swash plate 76. The reciprocation of the piston 78 draws refrigerant gas into a compression chamber 79 of the cylinder bore 77 from the suction chamber 81, compresses the gas in the compression chamber 79 and then discharges the gas into a discharge chamber 80. The gas in the discharge chamber 80 is drawn into a muffler chamber 72*a* of the muffler 72 via a discharge passage (not shown) and then discharged from the muffler chamber 72*a* to the external cooling circuit via the discharge port 73. Discharge of the refrigerant gas from the compression chamber 79 to the discharge chamber 80 causes pulsation of the gas flow. The pulsation and accompanying noise are reduced by drawing the gas into the muffler chamber 72*a*. The gas flows along the plates 74 in the muffler chamber 72*a* to the discharge port 73. This causes misted lubricant oil to collide with and adhere to the plates 74. The oil is separated form the refrigerant gas, accordingly.

The structure of the above described lubricate separating mechanism tends to be complex since it requires a plurality of plates 74 in the muffler chamber 72*a*. Thus, manufacturing of the above mechanism is troublesome. Further, flowing the gas along the plates 74 does not effectively separate lubricant oil from the gas.

SUMMARY OF THE INVENTION

Accordingly, it is an objective of the present invention to provide a lubricant oil separating mechanism for a compressor that has a simple structure and effectively separates lubricant oil form refrigerant gas.

To achieve the above objectives, the compressor according to the present invention includes a compressing device which compresses gas containing oil mist. The compressing device includes a compression chamber. A receiving chamber receives the compressed gas discharged from the compression chamber. The receiving chamber has a duct for discharging the gas from the receiving chamber. A hollow cylinder communicates with the duct and projects inside the receiving chamber. The gas directed toward the duct flows around the cylinder to generate centrifugal force for separating the oil mist from the gas.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a swash plate-type compressor embodying the present invention will be described below with reference to FIGS. 1 and 2.

Figure 1:
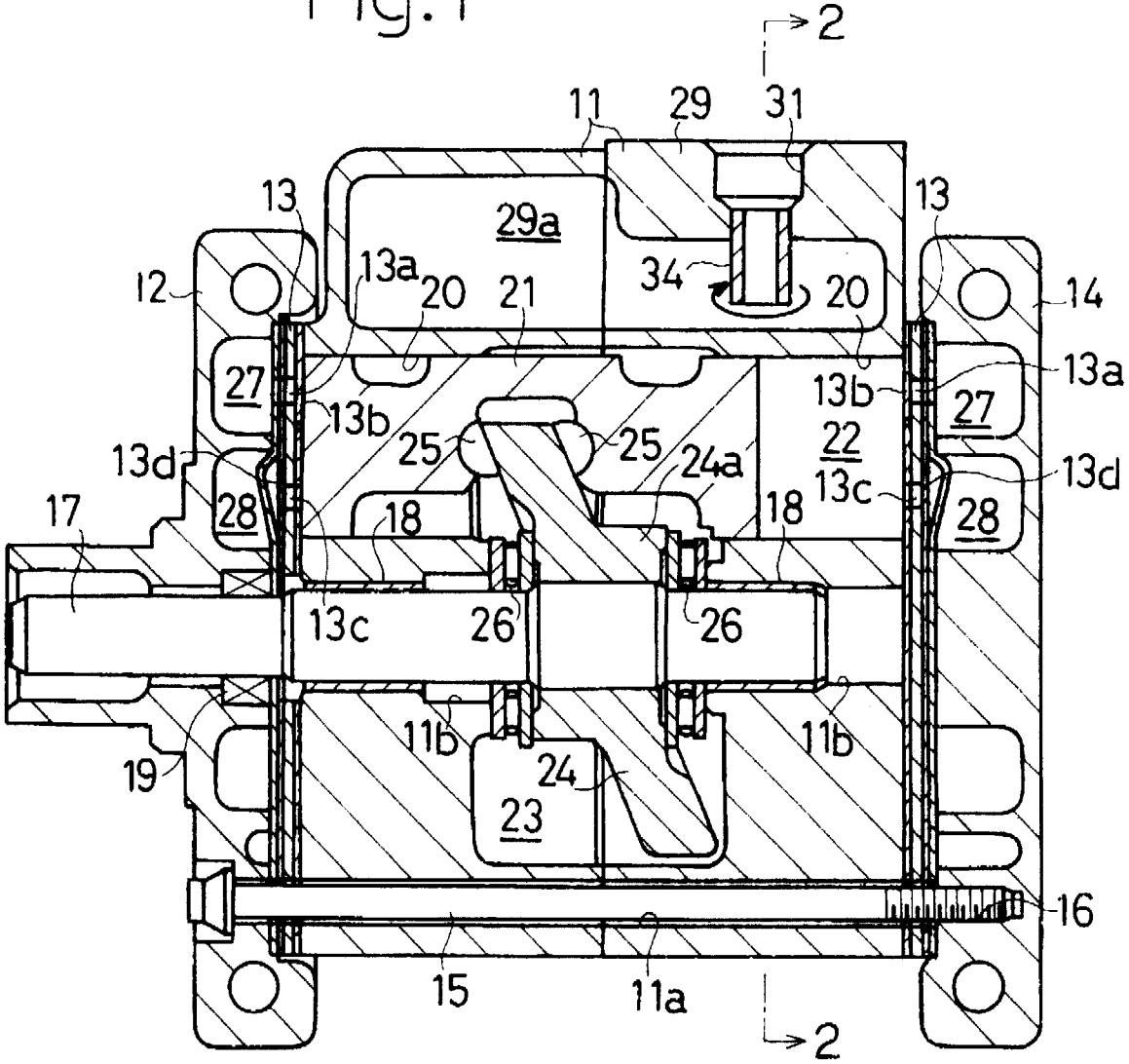
FIG. 1 is a sectional view illustrating a swash plate-type compressor according to a first embodiment of the present invention.

As shown in FIG. 1, a pair of cylinder blocks 11 are secured to each other at their ends. The pair of cylinder blocks 11 constitute a main housing. A front housing 12 is secured to the front end face of the front cylinder block 11 through a valve plate 13. A rear housing 14 is secured to the rear end face of the rear cylinder block 11 through a valve plate 13. A crank chamber 23 is formed between the cylinder blocks 11.

A plurality of bolts 15, which penetrate the front housing 12, cylinder blocks 11 and the valve plates 13, are screwed in screw holes 16 formed in the rear housing 14. The bolts 15 clamp and fix the front housing 12 and the rear housing 14 to the front end face and the rear end face of the cylinder blocks 11, respectively. A plurality of through holes 11*a* are formed in the cylinder blocks 11 through which the bolts 15 pass. The diameter of the through holes 11*a* is a little wider than that of the bolts 15.

A rotary shaft 17 is rotatably supported in the center of the cylinder blocks 11 and the front housing 12 with a pair of radial bearings 18. A support hole 11*b* is formed in the center of the cylinder blocks 11 to accommodate the rotary shaft 17. A seal member 19 is located between the rotary shaft 17 and the front housing 12. The rotary shaft 17 is connected to and rotated by an external power source such as an engine (not shown).

Figure 2:
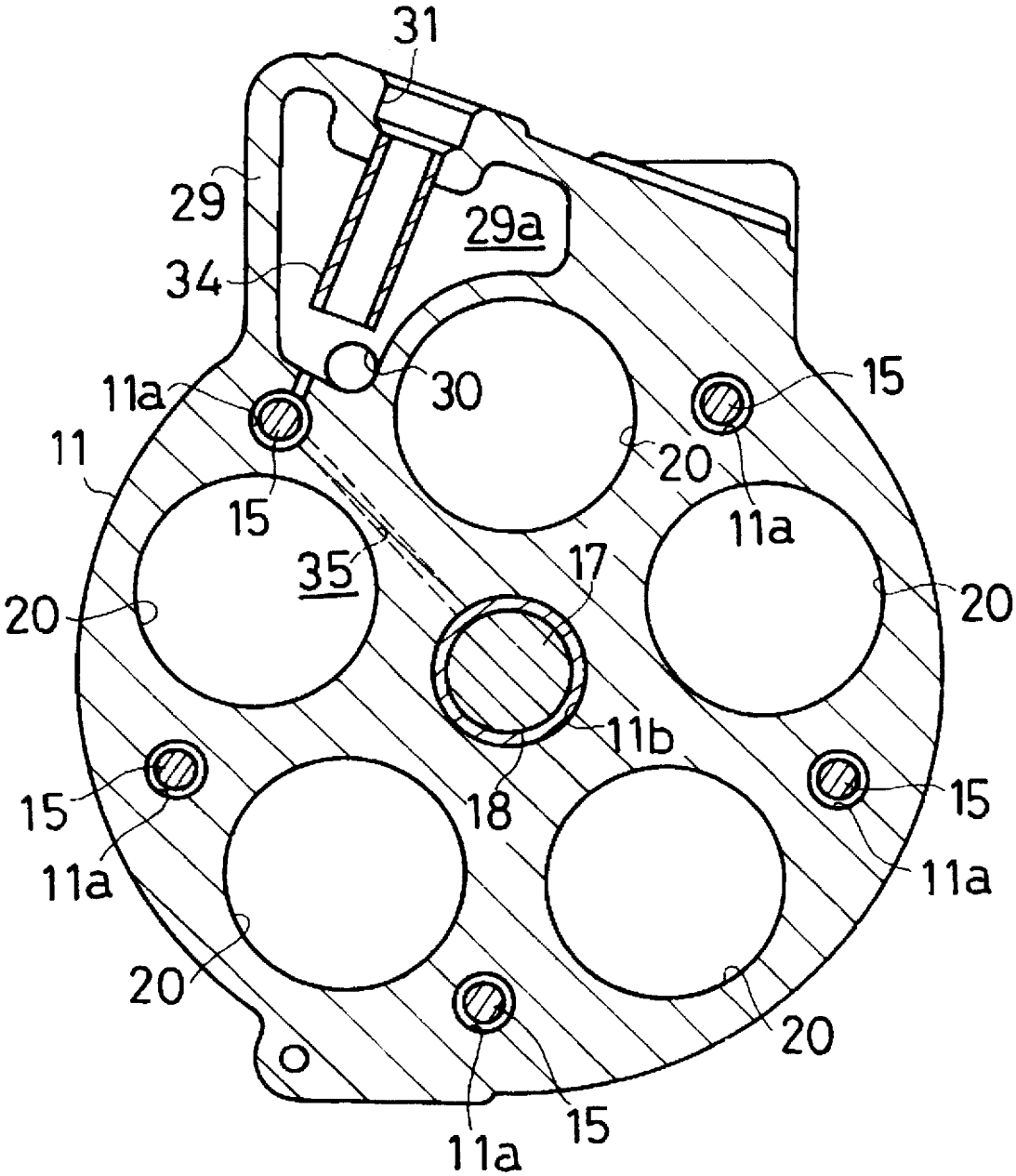
FIG. 2 is a sectional view taken along line 2—2 of FIG. 1.

A plurality of aligned pairs of cylinder bores 20 are formed parallel to one another in the cylinder blocks 11 such that the rotary shaft 17 is located centrally with respect to the bores 20 as shown in FIG. 2. The cylinder bores 20 are arranged with a predetermined space in between. A double-headed piston 21 is housed in each corresponding pair of cylinder bores 20. A compression chamber 22, which is defined by the end face of the associated piston 21 and the associated valve plate 13, is formed in each cylinder bore 20.

A swash plate 24 is fixed to the rotary shaft 17 and coupled to the central part of each piston 21 with a pair of semispherical shoes 25. The rotation of the swash plate 24 by the rotary shaft 17 is transmitted to each piston 28 through the shoes 25, and consequently, each piston 21 is reciprocated in the cylinder bores 20. A thrust bearing 26 is located between an inner wall surface of each cylinder blocks 11 and a boss 24*a* of the swash plate 24 in the crank chamber 23. The thrust bearings 26 hold the swash plate 24 between the cylinder blocks 11.

As shown in FIGS. 1 and 2, annular suction chambers 27 are formed in the periphery of the front and rear housings 12 and 14. The suction chambers 27 are connected to the external cooling circuit (not shown) via a suction port (not shown). Annular discharge chambers 28 are formed inside the suction chamber 27 in the front and rear housings 12 and 14. A discharge muffler 29 is formed in the top peripheral portion of the cylinder blocks 11. A muffler chamber 29*a* serving as a receiving chamber which receives compressed gas from the compression chambers 22, is formed in the discharge muffler 29. The muffler chamber 29*a* is connected to the discharge chamber 28 via a discharge passage 30 formed in the cylinder blocks 11 and the valve plates 13. A discharge duct 31 is formed in the top portion of the discharge muffler 29 to connect the muffler chamber 29*a* to an external cooling circuit.

Each valve plate 13 has a suction port 13*a*, a suction valve 13*b*, a discharge port 13*c* and a discharge valve 13*d*. When the piston 21 is in its suction stroke, i.e., when the piston 21 is moving from the top dead center to the bottom dead center, the refrigerant gas in the suction chamber 27 opens the suction valve 13*b* and is drawn into the compression chamber 22 of the cylinder bore 20 via the suction port 13*a*. The compression stroke of the piston 21, in which the piston 21 is moving from the bottom dead center to the top dead center, compresses the refrigerant gas in the compression chamber 22 of the cylinder bore 20. The gas then opens the discharge valve 13*d* and is discharged to the discharge chamber 28 through the discharge port 13*c*.

As shown in FIGS. 1 and 2, a lubricant oil separating cylinder 34 is snapped in or cemented to the discharge duct 31 so as to protrude inside the muffler chamber 29*a*. When compressed refrigerant gas in the discharge chamber 28 is discharged from the discharge duct 31 via the discharge passage 30 and the muffler chamber 29*a*, the gas revolves around the cylinder 34.

An oil guiding passage 35 (FIG. 2) is formed from the bottom of the muffler chamber 29*a* to the support hole 11*b* via one of the through holes 11*a*. Lubricant oil is separated from refrigerant gas by the cylinder 34 and then drops on the bottom of the muffler chamber 29*a* to be led to the support hole 11*b* via the oil guiding passage 35. The oil is then provided to the bearings 18 and 26 for lubricating them.

The action of the above swash plate-type compressor will be explained below.

The rotary shaft 17 is rotated by an external power source such as an engine (not shown). Rotation of the swash plate 24, which is accompanied by the rotation of the shaft 17, is converted by the shoes 25 to reciprocation of each piston 21 in the corresponding cylinder bore 20. The reciprocation of the piston 21 draws refrigerant gas into the compression chamber 22 of each cylinder bore 20 from an external cooling circuit via the suction chambers 27. The gas is compressed in the chamber 22 and discharged into the discharge chamber 28 and then drawn into the muffler chamber 29*a* via the discharge passage 30. The gas is discharged outside the compressor via the discharge duct 31.

The oil separating cylinder 34 attached to the discharge duct 31 protrudes inside the muffler chamber 29*a*. When refrigerant gas is discharged from the discharge duct 31, the gas revolves around the oil separating cylinder 34. Centrifugation caused by the revolution separates the misted oil from the refrigerant gas, thereby causing the oil to drop onto the bottom of the muffler chamber 29*a*. Although it has a very simple design, the oil separating cylinder 34 provided in the discharge duct 31 positively separates oil from refrigerant gas.

As a result, refrigerant gas containing oil is prevented from being discharged to an external cooling circuit. This improves the heat exchange efficiency of an evaporator incorporated in the cooling circuit. Cooling ability of the air conditioner is thus enhanced and the reliability of the compressor is increased, accordingly. Further, the simple design facilitates the manufacturing of the compressor, thereby reducing the cost of manufacturing.

Other embodiments of the present invention will be described below with reference to FIGS. 3 to 10.

Figure 3:
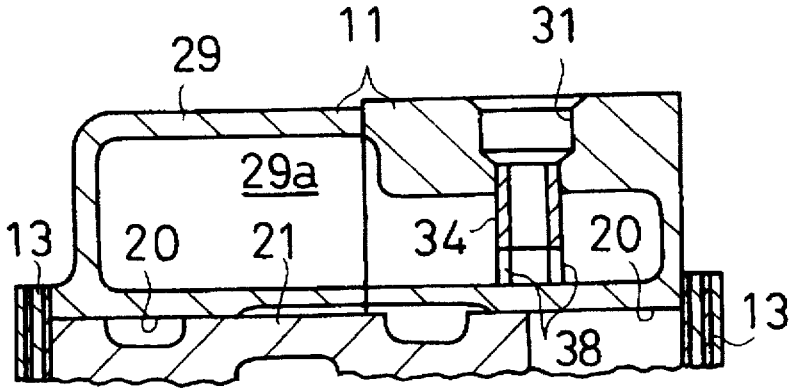
FIG. 3 is a partial sectional view illustrating a lubricant oil separating mechanism according to a second embodiment of the present invention.
Figure 4:
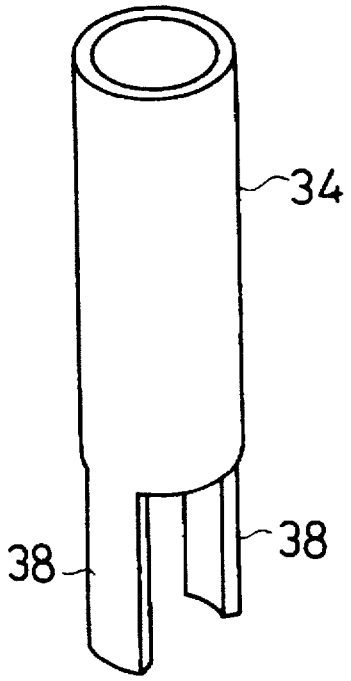
FIG. 4 is a perspective view illustrating a lubricant oil separating cylinder according to a second embodiment.

In the second embodiment shown in FIGS. 3 and 4, the lubricant oil separating cylinder 34 has a pair of protrusions 38 extending downward from the bottom end. The distal ends of the protrusions 38 touch the bottom of the muffler chamber 29*a*. This allows the cylinder 34 to be securely fixed to the muffler chamber 29*a*.

Figure 5:
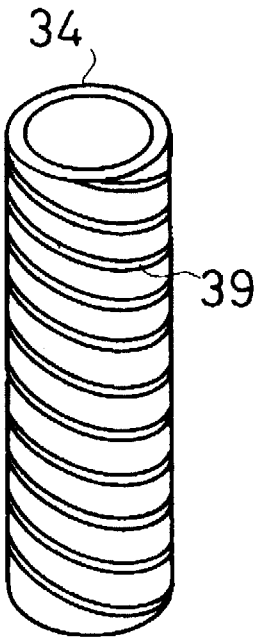
FIG. 5 is a perspective view illustrating a lubricant oil separating cylinder according to a third embodiment of the present invention.

In the third embodiment shown in FIG. 5, the lubricant oil separating cylinder 34 has a groove 39 formed spirally around its outer surface. When refrigerant gas revolves around the cylinder 34 before being discharged from the discharge duct 31, misted oil in the gas collides with and adheres to the groove 39. The oil in the gas is thereby effectively separated.

Figure 6:
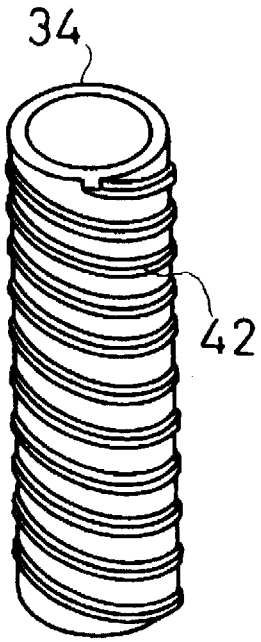
FIG. 6 is a perspective view illustrating a lubricant oil separating cylinder according to a fourth embodiment of the present invention.

In the fourth embodiment shown in FIG. 6, the lubricant oil separating cylinder 34 has a protrusion 42 formed spirally around its outer surface. When refrigerant gas revolves around the cylinder 34 before being discharged from the discharge duct 31, misted oil in the gas collides with and adheres to the protrusion 42. The oil in the gas is thereby effectively separated.

Figure 7:
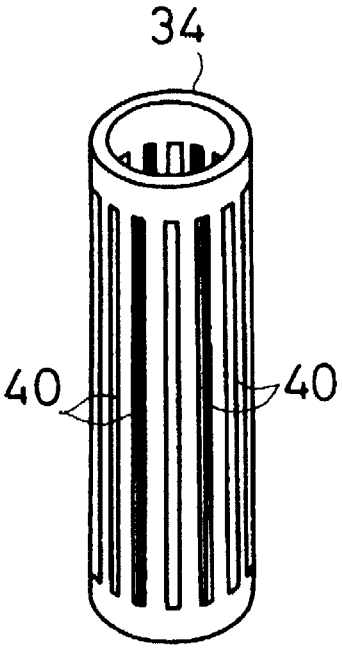
FIG. 7 is a perspective view illustrating a lubricant oil separating cylinder according to a fifth embodiment of the present invention.

In the fifth embodiment shown in FIG. 7, the lubricant oil separating 34 has a plurality of slits 40 formed along its axial direction with a predetermined space in between. When refrigerant gas revolves around the cylinder 34 before being discharged from the discharge duct 31, misted oil in the gas collides with and adheres to the slits 40. The oil in the gas is thereby effectively separated.

Figure 8:
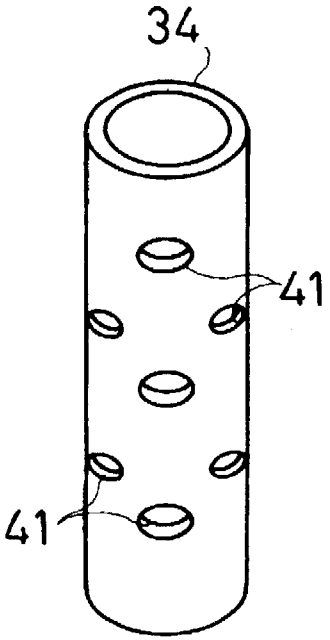
FIG. 8 is a perspective view illustrating a lubricant oil separating cylinder according to a sixth embodiment of the present invention.

In the sixth embodiment shown in FIG. 8, the lubricant oil separating cylinder 34 has a plurality of round through holes 41 with a predetermined space in between. When refrigerant gas revolves around the cylinder 34 before being discharged from the discharge duct 31, misted oil in the gas collides with and adheres to the through holes 41. The oil in the gas is thereby effectively separated.

Figure 9:
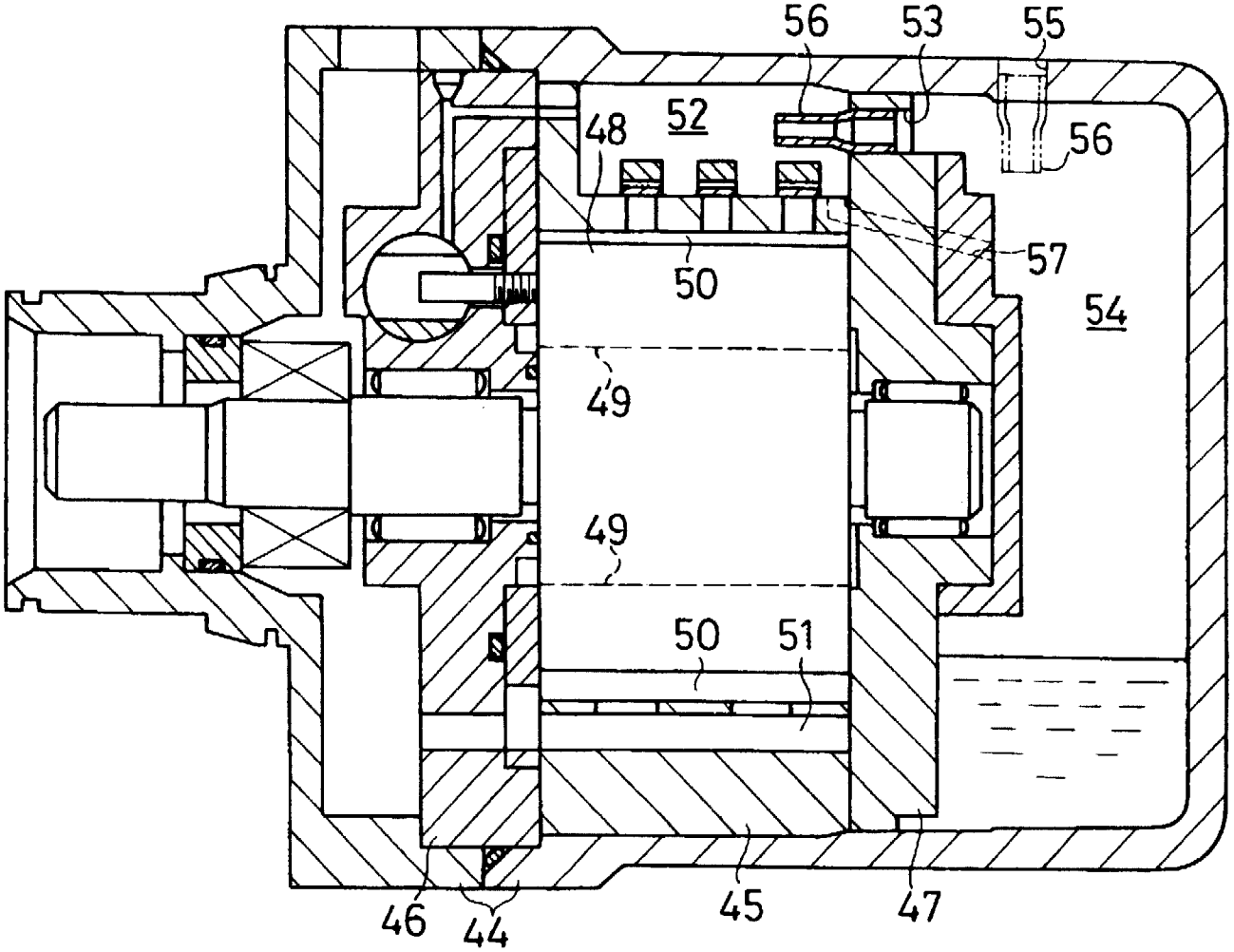
FIG. 9 is a sectional view illustrating a vane-type compressor according to a seventh embodiment of the present invention.

In the seventh embodiment shown in FIG. 9, the present invention is embodied in a vane-type compressor. The vane-type compressor has a pair of side plates 46 and 47 provided on the both sides of a cylinder 45 in a housing 44. A rotor 48 is rotatably supported between the plates 46 and 47. The rotor 48 has a plurality of vanes 49. The vanes 49 reciprocate in the radial direction of the rotor 48. The vanes 49, together with the inner wall of the cylinder 45 and the surface of the rotor 48, define a plurality of compression chambers 50. Rotation of the rotor 48 allows each compression chamber 50 to be alternately connected to a suction chamber 51 and a discharge chamber 52. This draws refrigerant gas from the suction chamber 51 to a compression chamber 50. The gas is compressed in the compression chamber 50 and then discharged into the discharge chamber 52.

The rear side plate 47 (the right side plate in FIG. 9) has a discharge port 53 formed therethrough. The gas discharged into the discharge chamber 52 is drawn into a lubricant oil separating chamber 54 through the port 53. The lubricant oil separating chamber 54 has a discharge duct 55 formed in the top wall. Refrigerant gas in the oil separating chamber 54 is led to an external cooling circuit via the discharge duct 55. An oil separating cylinder 56 is fixed to the discharge port 53. The cylinder 56 protrudes inside the discharge chamber 52. An oil guiding passage 57 is formed in the cylinder 45 and the rear side plate 47 for connecting the discharge chamber 52 and the oil separating chamber 54.

When being discharged into the oil separating chamber 54 from the discharge chamber 52 through the discharge port 53, refrigerant gas revolves around the oil separating cylinder 56. Centrifugation caused by the revolution separates the misted oil from the refrigerant gas. The separated oil is collected in the oil separating chamber 54 through the oil guiding passage 57. Although it has a very simple design, the oil separating cylinder 56 is provided in the discharge port 53 positively separates oil from refrigerant gas.

Figure 10:
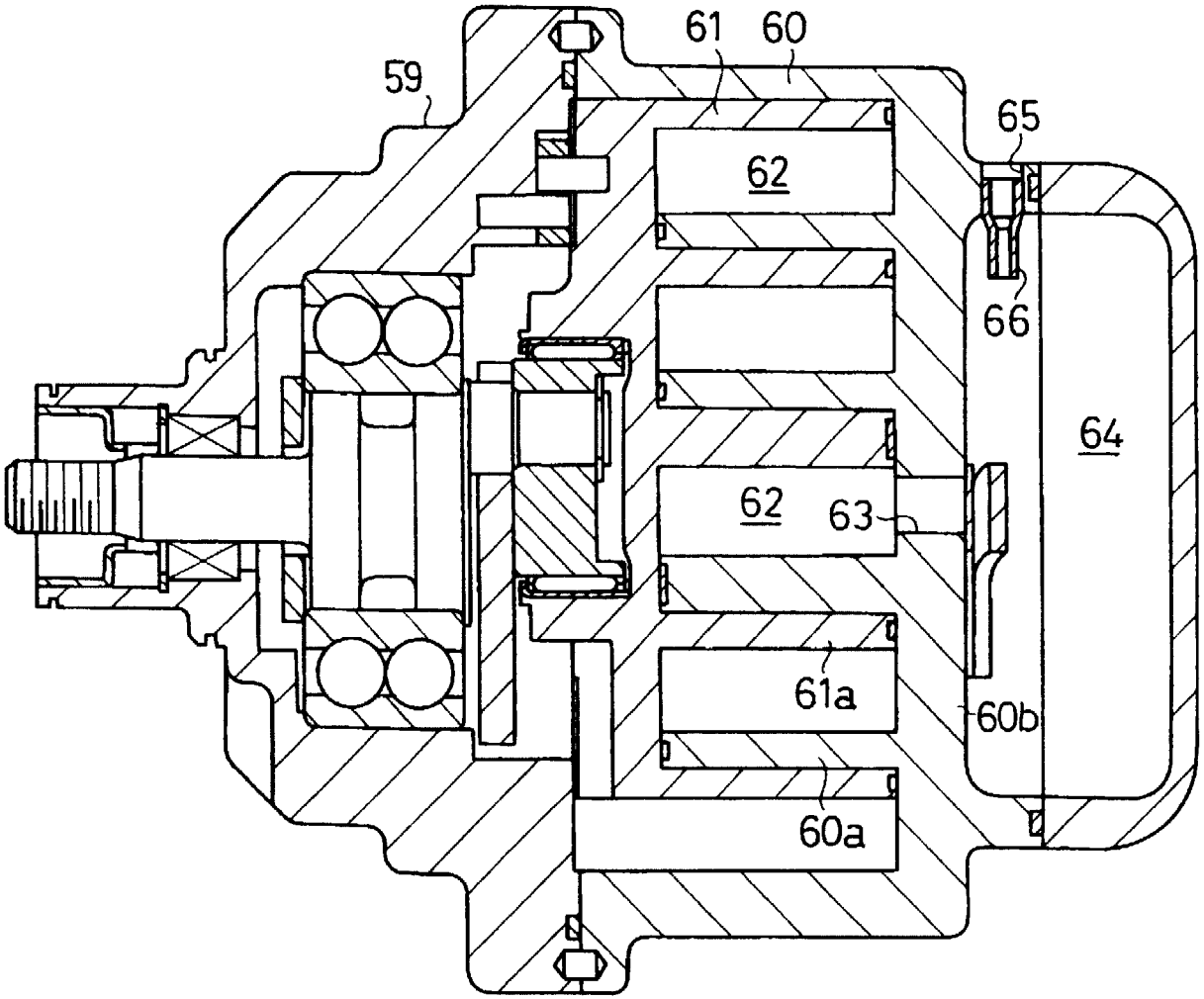
FIG. 10 is a sectional view illustrating a scroll-type compressor according to a eighth embodiment of the present invention.
Figure 11:
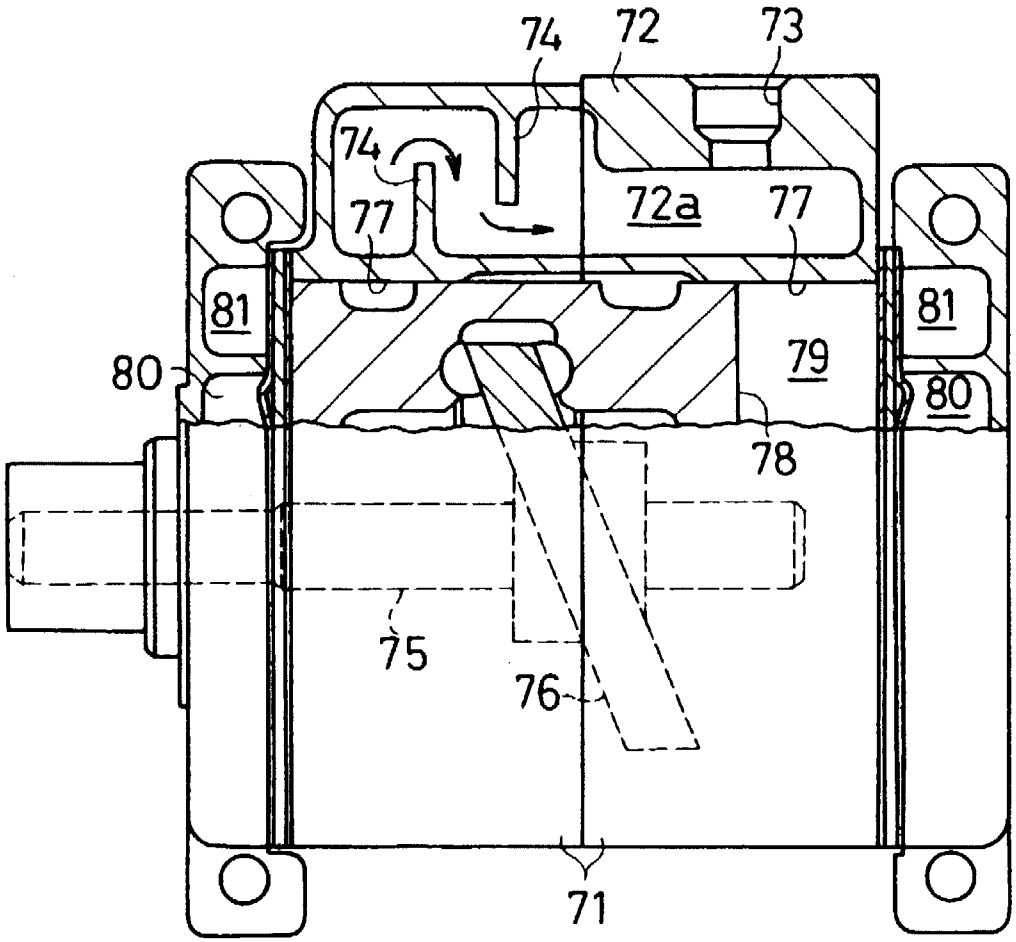
Fig.11 (Prior Art)
FIG. 11 is a partially cutaway side view of a swash plate-type compressor having a conventional lubricant oil separating mechanism.

In the eighth embodiment shown in FIG. 10, the present invention is embodied in a scroll-type compressor. The scroll-type compressor has a housing 59 secured to the front end of a fixed scroll 60. The fixed scroll 60 has a spiral element 60*a*. An orbiting scroll 61, which has a spiral element 61*a*, is provided between the housing 59 and the fixed scroll 60. The spiral element 61*a* of the orbiting scroll 61 is interfitted with the spiral element 60*a* of the fixed scroll 60. This forms a plurality of compression chambers 62 between the scrolls 60 and 61. As the orbiting scroll 61 orbits around the axis of the fixed scroll 60, the compression chambers 62 successively move toward the center portions of the spiral elements 60*a* and 61*a* and the volume of each compression chamber 62 decreases. Refrigerant gas in the compression chamber 62 is thus compressed.

A fixed plate 60*b* of the fixed scroll 60 has a discharge port 63 formed at the central portion thereof. After being compressed in the compression chamber 62, refrigerant gas is discharged into a discharge chamber 64 through the discharge port 63. The discharge chamber 64 has a discharge duct 65 formed in the top wall. Refrigerant gas in the discharge chamber 64 is led to an external cooling circuit via the discharge duct 65. An oil separating cylinder 66 is fixed to the discharge duct 65. The cylinder 66 protrudes inside the discharge chamber 64.

When being discharged from the discharge chamber 64 through the discharge duct 65, refrigerant gas revolves around the oil separating cylinder 66. Centrifugation caused by the revolving separates the misted oil from the refrigerant gas. The separated oil drops on the bottom of the discharge chamber 64. Although it has a very simple design, the oil separating cylinder 66 provided in the discharge duct 65 positively separates oil from refrigerant gas.

The present invention may be alternatively embodied in the following forms:

(a) In the first embodiment shown in FIGS. 1 and 2, the oil separating cylinder 34 may be provided in the discharge chamber 28 at the opening of the discharge passage 30.

(b) In the seventh embodiment shown in FIG. 9, the oil separating cylinder 56 may be fixed to the discharge duct 55 to protrude inside the lubricant oil separation chamber 54 as illustrated with an alternate long and two short dashes line.

(c) In the above embodiments, the oil separating cylinders 34, 56 and 66 may have a cross section that is less than a full circle. For example, a quarter or a third of the cylinders 34, 56 and 66 may be cut away along the axial direction.

Therefore, the present examples and embodiments are to be considered as illustrative and not restrictive, and the invention is not to be limited to the details giving herein, but may be modified within the scope of the appended claims.

What is claimed is:

1. A compressor which compresses gas containing oil mist comprising:

means for compressing the gas, said compressing means including a compression chamber;

a receiving chamber for receiving the compressed gas discharged from the compression chamber, said receiving chamber having a duct for discharging the gas from said receiving chamber; and a hollow cylinder communicating with the duct and projecting inside the receiving chamber, whereby said gas directed toward the duct flows around the cylinder for separating the oil mist from the gas, said cylinder having an outer surface such that the gas directed toward said duct flows in a circumferential direction around said outer surface, generating centrifugal force for separating the oil mist from the gas.

2. The compressor as set forth in claim 1 further comprising:

a discharge muffler for preventing pulsation of the gas flow according to the compressing operation in the compression chamber, said receiving chamber being defined within said muffler.

3. The compressor as set forth in claim 2, wherein said receiving chamber has an inner wall, and said cylinder has a protrusion contacting the inner wall of said receiving chamber.

4. The compressor as set forth in claim 2 further comprising:

a housing;

a rotary shaft rotatably supported in the housing;

a drive plate mounted on the rotary shaft;

a piston coupled to the drive plate;

a cylinder bore defined in the housing to accommodate the piston, said cylinder bore and said piston cooperably defining said compression chamber in the cylinder bore;

said drive plate converting a rotation of the rotary shaft to a reciprocating movement of the piston in the cylinder bore to compress the gas supplied into the compression chamber; and a discharge chamber for receiving the gas compressed in the compression chamber, wherein said gas in the discharge chamber is introduced into said receiving chamber.

5. The compressor as set forth in claim 4 further comprising:

a bearing disposed between said housing and said rotary shaft; and an oil guiding passage formed in the housing to provide said bearing with the oil received in said receiving chamber.

6. The compressor as set forth in claim 1, wherein said cylinder has a portion for facilitating a separation of the oil mist from the gas.

7. The compressor as set forth in claim 6, wherein said portion includes a spiral groove in the outer surface of said cylinder.

8. The compressor as set forth in claim 6, wherein said portion includes a spiral rib extending from the outer surface of said cylinder.

9. The compressor as set forth in claim 6, wherein said portion includes a plurality of slits extending along an axial direction of the cylinder.

10. The compressor as set forth in claim 6, wherein said portion includes a plurality of holes through the cylinder wall.

11. The compressor as set forth in claim 1, wherein said cylinder is securely connected with the duct.

12. The compressor as set forth in claim 1 further comprising:

a cylindrical body;

a rotor rotatably supported in the cylindrical body; and a vane radially movably arranged on the rotor, said vane defining said compression chamber between the cylindrical body and the rotor, wherein said gas is drawn and compressed in the compression chamber by the rotation of the rotor.

13. The compressor as set forth in claim 12 further comprising:

a discharge chamber for receiving the gas compressed in the compression chamber;

said receiving chamber including said discharge chamber; and said cylinder projecting inside the discharge chamber.

14. The compressor as set forth in claim 13 further comprising:

an oil separating chamber for receiving the gas from the discharge chamber; and an oil guiding passage for supplying the oil received in the discharge chamber to said separating chamber.

15. The compressor as set fourth in claim 12 further comprising:

a discharge chamber for receiving the gas compressed in the compression chamber;

an oil separating chamber for receiving the gas from the discharge chamber;

said receiving chamber including said separating chamber; and said cylinder projecting inside the separating chamber.

16. The compressor as set forth in claim 1 further comprising:

a fixed scroll;

an orbiting scroll disposed opposite to the fixed scroll to define said compression chamber between the orbiting scroll and the fixed scroll, said orbiting scroll being arranged to orbit around the axis of the fixed scroll to compress the gas supplied into the compression chamber;

a discharge chamber for receiving the gas compressed in the compression chamber;

said receiving chamber including said discharge chamber; and said cylinder projecting inside the discharge chamber.

17. A compressor comprising a rotary shaft rotatably supported in a housing, a drive plate mounted on the rotary shaft, and a piston coupled to the drive plate and accommodated in a cylinder bore, wherein said drive plate converts a rotation of the rotary shaft to a reciprocating movement of the piston in the cylinder bore to compress gas supplied into a compression chamber of the cylinder bore and discharge the compressed gas to a discharge chamber, said compressor further comprising:

a discharge muffler defined within the housing for preventing pulsation of the gas flow according to the compressing operation in the compression chamber;

a muffler chamber defined within said muffler, said muffler chamber receiving the gas discharged from said discharge chamber;

said muffler having a duct for discharging the gas from the muffler chamber; and a hollow cylinder communicating with the duct and projecting inside the muffler chamber to separate the oil mist from the gas, wherein said cylinder has an outer surface such that the gas directed toward the duct flows in a circumferential direction around the outer surface, generating centrifugal force for separating the oil mist from the gas.

18. The compressor as set forth in claim 17, wherein said muffler chamber has an inner wall and said cylinder has a protrusion contacting the inner wall of the muffler chamber.

19. The compressor as set forth in claim 17, wherein said cylinder has a portion for facilitating a separation of the oil mist from the gas.

20. The compressor as set forth in claim 19, wherein said portion includes a spiral groove in the outer surface of said cylinder.

21. The compressor as set forth in claim 19, wherein said portion includes a spiral rib extending from the outer surface of said cylinder.

22. The compressor as set forth in claim 19, wherein said portion includes a plurality of slits extending along an axial direction of the cylinder.

23. The compressor as set forth in claim 19, wherein said portion includes a plurality of holes provided through the cylinder wall.

24. The compressor as set forth in claim 17 further comprising:

a bearing disposed between said housing and said rotary shaft; and an oil guiding passage formed in the housing to provide said bearing with the oil received in the muffler chamber.

* * * * *